United States Patent [19]

Kasatkin et al.

[11] 4,001,522

[45] Jan. 4, 1977

[54] RIBBON TYPE LOUDSPEAKER

[76] Inventors: Alexei Fedoseevich Kasatkin, ulitsa Pravdy, 7/9, kv. 42; Jury Vasilievich Smirnov, ulitsa Alabyana, 11, kv. 44; Ilya Afanasievich Feldman, ulitsa Dubininskaya, 6, korpus 1, kv. 269, all of Moscow, U.S.S.R.

[22] Filed: Jan. 5, 1976

[21] Appl. No.: 646,417

[30] Foreign Application Priority Data

Jan. 14, 1975 U.S.S.R. ..... 2090005

[52] U.S. Cl. ..... 179/115 V

[51] Int. Cl.[2] ..... H04R 9/02

[58] Field of Search ..... 179/115 V

[56] References Cited

FOREIGN PATENTS OR APPLICATIONS 939,508 11/1948 France ..... 179/115 V

*Primary Examiner*—George G. Stellar

*Attorney, Agent, or Firm*—Lackenbach, Lilling & Siegel

[57] ABSTRACT

According to the invention, the ribbon type loudspeaker comprises permanent magnets defining a magnetic system and sound reproducing ribbons extending in the working gaps between the pole pieces of the permanent magnets. The sound reproducing ribbon is made up of individual conductive strips applied onto a dielectric backing parallel with one another, with spaces left therebetween, longitudinally of the sound reproducing ribbon. The disclosed ribbon type loudspeaker enables improvement of the quality of sound reproduction and simultaneously prolongs the service life of the loudspeaker.

1 Claim, 2 Drawing Figures

RIBBON TYPE LOUDSPEAKER

The present invention relates to electroacoustic transducers and, more particularly, it relates to ribbon type loudspeakers.

The invention can be utilized in domestic sound reproducing apparatus, in cinema halls, in concert halls and in other applications where high fidelity of sound reproduction is required.

There are already known in the art ribbon type loudspeakers comprising permanent magnets defining a working gap accommodating therein a sound reproducing ribbon in the form of a solid strip of an electrically conductive material.

The magnetic induction or flux density within the working gap between the permanent magnetis, while having relatively great values adjacent to the poles of the magnets, rapidly diminishes toward the center of the working gap. Therefore, the electromagnetive force acting on the edges of the sound reproducing ribbon is substantially greater than that acting on the central part thereof. This results in the fact that co-phasal state of oscillation of all the points of the sound reproducing ribbon cannot be ensured to an adequately high degree, on account of travelling waves being generated across the width of the ribbon. The amplitude of oscillation of the edges of the sound reproducing ribbon being greater than that of the central part thereof, in combination with affected co-phasal state of this oscillation, brings about various distortions of sound.

Furthermore, in this case the central portion of the sound reproducing ribbon acts in fact as a load applied to the edges thereof, which is another source of distortion of sound. And, finally, with oscillation of the sound reproducing ribbon being practically reduced to its edges, the ribbon permanently operates under the conditions of a transverse bending strain, which might result in an untimely breakdown.

One known ribbon type loudspeaker has its sound reproducing ribbon in the form of a solid strip having a varying thickness in the longitudinal direction, the thickness increasing from the central part of the ribbon toward its ends, i.e. toward the points where the ribbon is secured to a support frame. This feature is aimed at minimizing the distortion of sound, caused by the presence of travelling waves longitudinally of the sound reproducing ribbon. However, in this loudspeaker nothing is done to curb the adverse influence of waves travelling across the width of the sound reproducing ribbon. Consequently, the last-mentioned hitherto known ribbon type loudspeaker is not free from the abovespecified drawbacks caused by non-uniformity of the magnetic flux across the working gap.

It is an object of the present invention to improve the sound reproduction quality of a ribbon type loudspeaker and to prolong the service life of the sound reproducing ribbon thereof.

These and other objects are attained in a ribbon type loudspeaker comprising permanent magnets defining a magnetic system and sound reproducing ribbons, each ribbon extending in a working gap between the pole pieces of the respective permanent magnets, in which loudspeaker, in accordance with the invention, the sound reproducing ribbon includes individual conductive strips applied onto a dielectric backing parallel with one another with spaces left therebetween, longitudinally of the sound reproducing ribbon.

The present invention will be further described in connection with embodiments thereof, with reference being had to the accompanying drawings, wherein.

Figure 1:
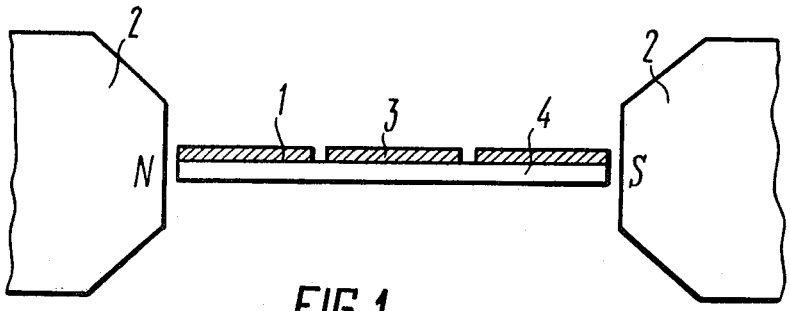
FIG. 1 illustrates the structure of a sound reproducing ribbon with conductive strips applied onto one side of a dielectric backing, according to the invention.

In the drawings, the ribbon type loudspeaker comprises a sound reproducing ribbon 1 (FIG. 1) accommodated within a working gap between the pole pieces N and S of permanent magnets 2. The sound reproducing ribbon 1 is shown in cross-section, while the pole pieces N and S of the permanent magnets 2 are shown in a projection perpendicular to the direction of a current of audio frequency flowing through the sound reproducing ribbon 1. The sound reproducing ribbon 1 has individual current-conducting strips 3 applied either with aid of an adhesive or by sputtering onto one side of a dielectric backing 4 with spaces left therebetween. The quantity of the conductive strips 3 is not less than three.

Figure 2:
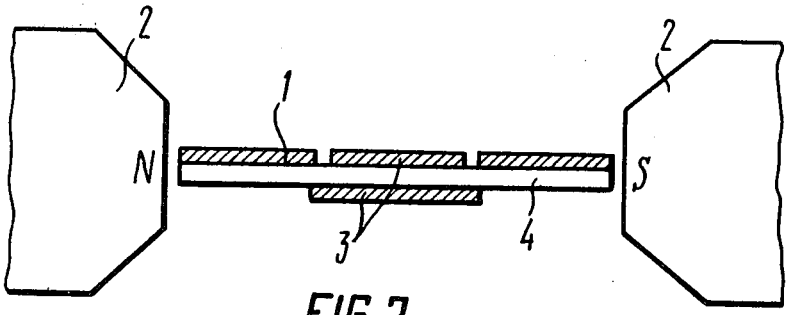
FIG. 2 illustrates the structure of a sound reproducing ribbon with conductive strips applied onto both sides of a dielectric backing, according to the invention.

Alternatively, the current-conducting strips 3 (FIG. 2) can be applied onto both sides of the dielectric backing 4.

With the sound reproducing ribbon 1 (FIG. 1) including individual conductive strips 3, it becomes possible to compensate for non-uniformity of the magnetic flux within the working gaps by selecting correspondingly the values of the current of audio frequency through the respective ones of the conductive strips 3, so that at any given moment of time the following condition shall be met as perfectly as possible:

$$B_k \cdot i_k = \text{const} \qquad 1,$$

where $K = 1, 2, \ldots n;$ $n \geqslant 3;$ $B_k$ is the mean value of the magnetic induction at the area of the $k$th conductive strip 3;

$n$ is the total number of the conductive strips 3.

With the above condition satisfied, there is ensured a levelling out of the values of the electromagnetic force at various points of the sound reproducing ribbon 1.

A proper choice of the required values of the current of audio frequency flowing through individual ones of the conductive strips is effected by an appropriate combination of parallel and series electric connections of the conductive strips 3 with one another.

The disclosed ribbon type loudspeaker has been found to improve the fidelity of sound reproduction.

What is claimed is:

1. A ribbon type loudspeaker comprising:

a. permanent magnets defining a magnetic system; a working gap between pole pieces of said permanent magnets;

b. at least one sound reproducing ribbon extending in the working gap between the pole pieces of said permanent magnets; and a dielectric backing of said sound reproducing ribbon, conductive strips of said sound reproducing ribbon applied onto said dielectric backing parallel with one another, with spaces left therebetween, longitudinally of said sound reproducing ribbon.

* * * * *